US008042315B2

(12) United States Patent
Ashton et al.

(10) Patent No.: US 8,042,315 B2
(45) Date of Patent: Oct. 25, 2011

(54) REINFORCED COMPOSITE PANEL

(75) Inventors: Larry J. Ashton, Mapleton, UT (US); Michael G. Allman, Spanish Fork, UT (US); Troy L. White, Goshen, UT (US); Craig B. Simpson, Mapleton, UT (US); Benko S. Ta'ala, Elk Ridge, UT (US)

(73) Assignee: Spectrum Aeronautical, LLC, Carlsbad, CA (US)

( * ) Notice: Subject to any disclaimer, the term of this patent is extended or adjusted under 35 U.S.C. 154(b) by 528 days.

(21) Appl. No.: 11/855,334

(22) Filed: Sep. 14, 2007

(65) Prior Publication Data

US 2009/0071098 A1 Mar. 19, 2009

(51) Int. Cl.
*E04C 2/32* (2006.01)

(52) U.S. Cl. ..... 52/783.19; 52/783.11; 52/783.18; 244/119

(58) Field of Classification Search ..... 52/630, 52/783.1, 783.19, 783.11, 783.18; 428/119, 428/122; 244/119, 123.1, 133
See application file for complete search history.

(56) References Cited

U.S. PATENT DOCUMENTS

| | | | | | |
|---|---|---|---|---|---|
| 1,469,220 | A * | 10/1923 | Kemp | 244/87 |
| 2,319,675 | A | 5/1943 | Grinter | |
| 2,413,737 | A | 1/1947 | Weaver | |
| 3,023,860 | A * | 3/1962 | Ellzey | 244/120 |
| 3,156,070 | A * | 11/1964 | Mesnager | 52/18 |
| 3,299,598 | A * | 1/1967 | Alleaume | 428/604 |
| 3,669,821 | A * | 6/1972 | Sharp | 428/184 |
| 3,859,162 | A | 1/1975 | Johnson et al. | |
| 3,995,080 | A | 11/1976 | Cogburn et al. | |
| 4,292,375 | A * | 9/1981 | Ko | 428/593 |
| 4,472,473 | A * | 9/1984 | Davis et al. | 428/184 |
| 4,769,968 | A * | 9/1988 | Davis et al. | 52/798.1 |
| 4,966,802 | A | 10/1990 | Hertzberg | |
| 6,427,945 | B1 * | 8/2002 | Bansemir | 244/129.1 |
| 6,482,497 | B1 | 11/2002 | Kay et al. | |
| 6,889,937 | B2 | 5/2005 | Simpson et al. | |
| 7,074,474 | B2 | 7/2006 | Toi et al. | |
| 7,159,822 | B2 * | 1/2007 | Grantham et al. | 244/119 |
| 2002/0189195 | A1 * | 12/2002 | McKague et al. | 52/783.19 |
| 2003/0186038 | A1 | 10/2003 | Ashton et al. | |
| 2004/0070108 | A1 | 4/2004 | Simpson et al. | |
| 2004/0079838 | A1 | 4/2004 | Simpson et al. | |
| 2005/0003145 | A1 * | 1/2005 | Toi et al. | 428/102 |
| 2005/0211843 | A1 | 9/2005 | Simpson et al. | |

* cited by examiner

*Primary Examiner* — Brian Glessner
*Assistant Examiner* — Jessie Fonseca
(74) *Attorney, Agent, or Firm* — Nydegger & Associates

(57) ABSTRACT

A reinforced panel, made of a composite material, includes a single base layer. A first plurality of mutually parallel ridges is affixed to the surface of the base layer. A second plurality of mutually parallel ridges is also affixed to the surface of the base layer, but oriented transverse to the first plurality. Structurally, the ridges and the base layer are co-cured to create an integral, continuous structure that provides stiffness and rigidity to the panel.

8 Claims, 1 Drawing Sheet

REINFORCED COMPOSITE PANEL

FIELD OF THE INVENTION

The present invention pertains generally to structures that are made of composite materials. More particularly, the present invention pertains to rigid panels, and similar type structures, that are made with reinforced composite materials. The present invention is particularly, but not exclusively, useful as a one-piece reinforced composite material that is suitable for use as the external surface structure for a high-speed vehicle, such as an aircraft.

BACKGROUND OF THE INVENTION

A composite material is a structural material that is made of two or more different materials. Cermet for example, is a composite material made of ceramic articles that are bonded with metal. Another type of widely used composite material is made of carbon fibers that are reinforced with an epoxy resin. It is this last type of composite material (i.e. carbon fiber/epoxy) that is of interest for the present invention.

Carbon fiber composite materials are unique in several aspects when they are used as a structural material. For one, unlike many other types of construction materials, they can be accurately pre-formed to assume complex shapes. For another, after they have been cured, they exhibit very good strength in both tension and compression. Carbon fiber composite materials, however, are typically made as relatively thin layers and, as such, they can be somewhat floppy. In many applications, this may be undesirable. The solution for such applications is to then somehow reinforce the layer of composite material in a manner that will stiffen and make the material rigid for its use as a support structure.

By structural analysis, it can be shown that a bending moment results wherever a force couple is applied to a structure. This bending moment can be resisted, however, when portions of the structure are distanced from each other and are located in the same bending plane, with a same center of bending. Indeed, the more material that is in the respective portions, and the greater the distance between them, the greater will be the structure's ability to resist bending. The well-known I-beam is a good basic example of such a structure.

Insofar as composite materials are concerned, and as noted above, although they may be formed as thin layers, and are therefore susceptible to being floppy, they typically have good strength characteristics in both tension and compression. Again, by way of example, an I-beam requires these strength characteristics. Heretofore, when a stiff, rigid structure has been required, and it has been desirable to use composite materials for its construction, it has been common to use two different layers of the composite material. The layers of composite material are then distanced from each other and interconnected by another structure, such as honeycomb. Unfortunately, even though composite materials and honeycomb are both relatively light-weight when compared with other structural materials, they still add weight. In the two-layer example considered above, the additional layer of composite material and the honeycomb may add substantial weight. For some applications (e.g. the manufacture of aircraft) weight limitation is of the utmost importance.

In light of the above, it is an object of the present invention to provide a reinforced panel, made of a composite material, that is sufficiently stiff and rigid to resist operational bending forces. Another object of the present invention is to provide a reinforced panel, made of a composite material, that is extremely light weight. Yet another object of the present invention is to provide a reinforced panel that is suitable for use as the external surface of a high performance aircraft. Another object of the present invention is to provide a reinforced panel that is relatively simple to manufacture, is easy to use and is comparatively cost effective.

SUMMARY OF THE INVENTION

In accordance with the present invention, a reinforced panel includes a single base layer of a composite material that has continuations extending from a surface thereof. It is these continuations that provide the reinforcing structure for the panel. In detail, as intended for the present invention, the continuations are formed as ridges that rise a predetermined distance from the surface of the layer. Further, there is a first plurality of mutually parallel ridges. There is also a second plurality of mutually parallel ridges that is transverse to the first plurality of ridges. Together, these pluralities of ridges can be arranged as either an ortho-grid, or as an iso-grid.

Structurally, the continuations (ridges) are each formed with a substantially U-shaped cross section. As so formed they have a base portion and a pair of substantially parallel and opposite legs that extend from the base portion to a respective edge. With this structure, there are effectively three embodiments for the reinforced panel of the present invention. These embodiments primarily differ from each other by the manner in which the edges of the ridges are affixed to the base layer of composite material. And, in one embodiment, a unidirectional ply is added to provide additional structure for reaction to forces borne by the base portion of the ridge.

In a preferred embodiment of the present invention, the legs of the ridges are continuations of the surface, and are thus affixed directly to the surface of the base layer. For this embodiment, a unidirectional ply is added to span the distance between opposite legs of each ridge, and to thereby provide additional structure for reaction to forces borne by the cross section of the ridge (continuation). In another embodiment, the edges of each ridge are formed as feet and the panel includes overlap layers that cover each foot and extend therefrom to contact the surface of the base layer and the leg. The overlap layer is then bonded to the base layer, and to the leg to affix the ridge to the base layer. In a third embodiment, the base layer is formed with a plurality of flaps. Specifically, each flap extends from an edge of a ridge and into the channel that is formed between the legs of the ridge. The flap is then bonded to the leg inside the channel. For the embodiment wherein an overlap layer is used, the flap is bonded to the side of the leg that is opposite the overlap layer. In all embodiments, the ridges are integrally bonded to the surface of the base layer to become continuations of the base layer. Also, they are arranged in a grid as mentioned above, to create the reinforced panel.

It is an important aspect of the present invention that the ridges be a continuation of the base layer, and that a portion of the ridge be distanced from the surface of the base layer by a predetermined distance "h". Also, as implied above, it is an important aspect of the present invention that the panel is pre-formed with all of the components integrally associated with each other before they are all co-cured.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
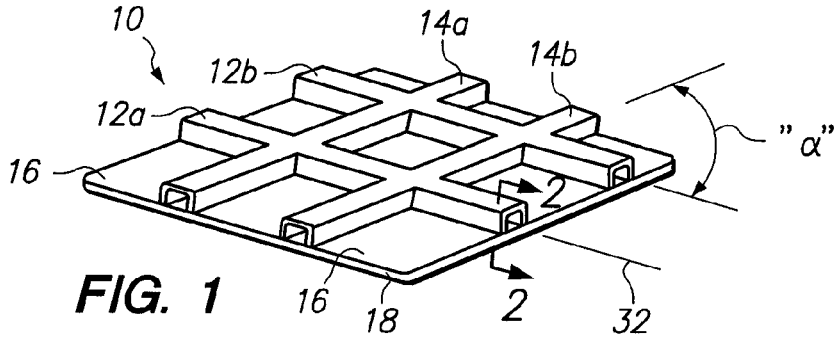
FIG. 1 is a perspective view of a reinforced panel in accordance with the present invention.

Referring initially to FIG. 1, a reinforced panel in accordance with the present invention is shown and is generally designated 10. As shown, the panel 10 includes a plurality of mutually parallel ridges 12, and a plurality of mutually parallel ridges 14. Further, the ridges 14 are transverse to the ridges 12 and intersect them at an angle "α". FIG. 1 also shows that the ridges 12 and 14 are mounted on the surface 16 of a common base layer 18.

For purposes of disclosure, the ridges 12*a* and 12*b* are shown as only being exemplary of additional such ridges 12. Likewise, the ridges 14*a* and 14*b* are also only exemplary. Further, although the term "ridge" is most frequently used herein to describe the structure shown and indicated by the numerical designators "12" or "14", it is to be appreciated that the ridges 12/14 are, functionally, "stiffening members" for the panel 10 and are, structurally, "continuations" of the base layer 18. Consequently, the terms "ridge", "stiffening member" and "continuation" may be used interchangeably herein. Also, as will be appreciated by the skilled artisan, the ridges 12/14 will form an ortho-grid when the angle "α" is a right angle. Otherwise, the ridges 12/14 will form an iso-grid.

Figure 2:
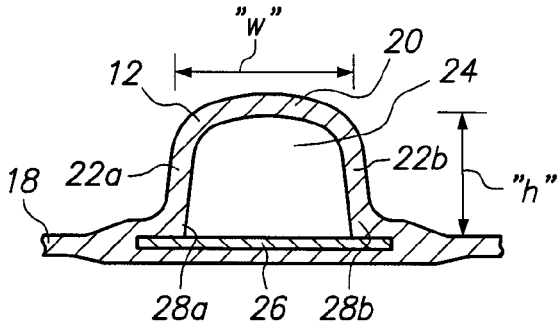
FIG. 2 is a cross-sectional view of a preferred embodiment of a stiffening member (ridge) for use with the present invention, as seen along the line 2-2 in FIG. 1.

Turning now to FIG. 2, the structural construction of a preferred embodiment for a ridge 12/14 is shown in detail. In FIG. 2 it will be seen that the ridge 12 has a substantially U-shaped, cross-sectional configuration (shown inverted in FIG. 2). This configuration includes a base portion 20. Also, extending substantially parallel from the base portion 20 are legs 22*a* and 22*b* that, together with the base portion 20, define a channel 24. As shown, the legs 22*a* and 22*b* are distanced from each other by a distance "w", and the base portion 20 is distanced from the base layer 18 by a distance "h". For purposes of the present invention, the respective distances "w" and "h" can be varied as desired for the particular application.

Figure 3:
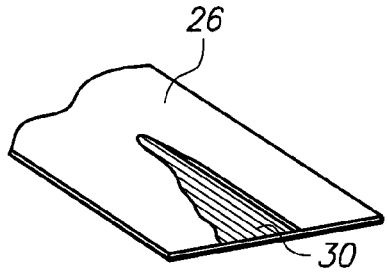
FIG. 3 is a perspective view of a unidirectional ply, as used for the preferred embodiment of the present invention, with portions broken away for clarity.

Still referring to FIG. 2, a preferred embodiment of the present invention includes a unidirectional ply 26 that extends in the plane of the base layer 18 and interconnects the leg 22*a* with the leg 22*b*. More specifically, each of the legs 22*a* and 22*b* terminate at a respective edge 28*a* and 28*b*, and it is these edges 28*a* and 28*b* that engage with the unidirectional ply 26. Turning to FIG. 3, it will be seen that the unidirectional ply 26 is characterized by having a plurality of tows 30 that are aligned substantially in parallel with each other during the manufacture of the ply 26. Consequently, the maximum tension force that can be resisted by the unidirectional ply 26 will be a force that is applied in the direction of the aligned tows 30. Thus, during the construction of a ridge 12 (e.g. ridge 12*a* in FIG. 1) the unidirectional ply 26 is positioned at a distance "h" from the base portion 20 of the ridge 12 (see FIG. 2), with the tows 30 of ply 26 aligned substantially parallel to the axis 32 of the channel 24.

Figure 4:
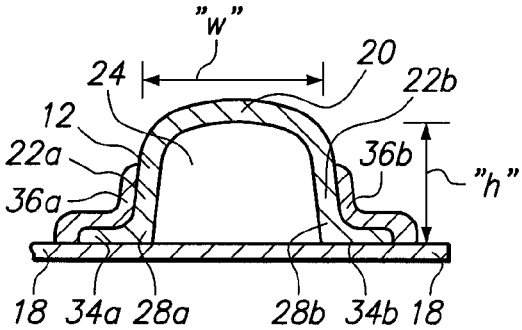
FIG. 4 is a cross-sectional view of an alternate embodiment of a stiffening member (ridge) for use with the present invention, as would be seen along the line 2-2 in FIG. 1.
Figure 5:
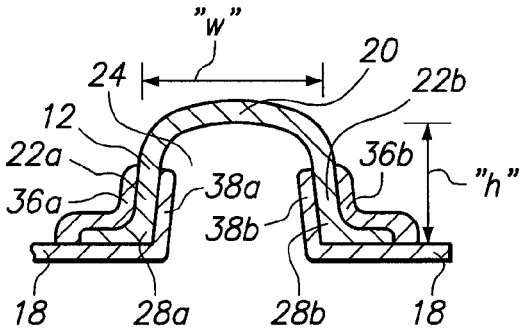
FIG. 5 is a cross-sectional view of a modified alternate embodiment of a stiffening member (ridge) for use with the present invention, as would be seen along the line 2-2 in FIG. 1.

In an alternate embodiment for the panel 10 of the present invention, shown in FIG. 4, the ridge 12 includes legs 22*a* and 22*b* that are each formed with a foot 34*a* and 34*b* at the respective edges 28*a* and 28*b* of the legs 22*a* and 22*b*. Further, an overlap layer 36*a* is positioned over the foot 34*a* and is secured to the leg 22*a*, as well as the base layer 18. Similarly, an overlap layer 36*b* is positioned over the foot 34*b* and is secured to the leg 22*b*, as well as the base layer 18. In another alternate embodiment for the panel 10 of the present invention, shown in FIG. 5, the embodiment shown in FIG. 4 is modified by cutting the base layer 18 along the middle of the channel 24. This creates a pair of opposed flaps 38*a* and 38*b*. These flaps 38*a* and 38*b* are then folded into the channel 24 and into contact with the side of respective legs 22*a* and 22*b*.

Figure 6:
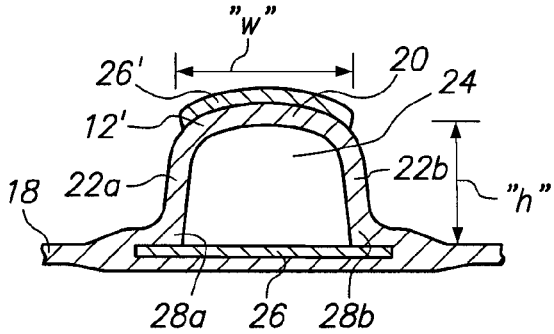
FIG. 6 is a cross-sectional view of another preferred embodiment of a stiffening member (ridge) for use with the present invention, as would be seen along the line 2-2 in FIG. 1.

For yet another preferred embodiment of the present invention, refer to FIG. 6. There it will be seen that a second unidirectional ply 26' is added onto the base portion 20 of a stiffening member (ridge) 12. Specifically, as shown in FIG. 6, this additional ply 26' is affixed to the base portion 20 and is positioned substantially at the distance "h" from the unidirectional ply 26 on base layer 18. Consequently, the ply 26 and the ply 26' will alternatively resist tension forces that are imposed during a bending of the panel 10. With the exception of the additional unidirectional ply 26', the ridge 12 that is shown in FIG. 6 is similar in all other important respects to the ridge 12 shown in FIG. 2.

Although the disclosure above has been directed primarily to a single ridge 12, it is to be appreciated that the disclosure applies equally to all ridges 12/14 of the reinforced panel 10. Moreover, for all embodiments of the present invention (i.e. ridges 12 shown in FIGS. 2, 4, 5 and 6), the construction material for the base panel 18 and for the ridges 12/14 is a composite material. Preferably, this composite material is a combination of carbon fibers and epoxy resin. Also, for all embodiments of the present invention, it is intended that after the composite material components have been assembled as disclosed above, the entire combination is co-cured. The consequence of this is a reinforced panel 10 that is essentially of a one-piece, unitary structure wherein the cooperative resistance of the base portion 20 and the base layer 18 (along with ply 26 and ply 26' in the preferred embodiments (see FIG. 2 and FIG. 6)) provide stiffness and rigidity for the panel 10.

While the particular Reinforced Composite Panel as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A reinforced panel which comprises:

a base layer made of a composite material, said base layer having a surface;

a first elongated stiffening member having a substantially U-shaped cross section with a base portion and a pair of substantially parallel and opposite legs extending from the base portion to a respective edge to define a channel therebetween, wherein each edge of the first elongated stiffening member is integrally affixed to the surface of said base layer to position the base portion of said first elongated stiffening member at a distance "h" from said base layer;

a second elongated stiffening member having a substantially U-shaped cross section with a base portion and a pair of substantially parallel and opposite legs extending from the base portion to a respective edge to define a channel therebetween, wherein each edge of the second elongated stiffening member is integrally affixed to the surface of the base layer to position the base portion of said second stiffening member at the distance "h" from said base layer, and wherein the second elongated stiffening member is oriented transverse to the first stiffening member to therewith reinforce the base layer and create the panel;

a plurality of flaps formed from the base layer wherein each flap extends from an edge of a respective stiffening member and into the channel thereof, and further wherein each flap is bonded to a leg of the respective stiffening member and further wherein each edge of the respective stiffening member is formed as a foot for the respective legs; and a plurality of overlap layers wherein each overlap layer covers the foot of a each of the respective legs and extends therefrom for contact with the surface of the base layer and with the legs of the respective stiffening member to bond therewith and secure the respective stiffening member to the base layer, and wherein each flap is bonded to each of the respective legs of the respective stiffening member opposite from the overlap layers.

2. A panel as recited in claim 1 wherein said first and second elongted stiffening members are made of a composite material and are co-cured with said base layer.

3. A panel as recited in claim 1 wherein the legs of the first elongated stiffening member are respectively opposite each other and separated by a distance "w" and the legs of the second elongated stiffening member are respectively opposite each other and are separated from each other by the distance "w".

4. A panel as recited in claim 1 further comprising a plurality of first elongated stiffening members wherein the first elongated stiffening members are substantially mutually parallel, and a plurality of second elongated stiffening members wherein the second elongated stiffening members are substantially mutually parallel, and wherein the first stiffening elongated members are oriented at an angle "$\alpha$" relative to the second elongated stiffening members.

5. A reinforced panel which comprises:

a base layer made of a composite material, said base layer having a surface;

a first plurality of elongated ridges, wherein each ridge in said first plurality is substantially parallel to every other ridge in said first plurality;

a second plurality of elongated ridges, wherein each ridge in said second plurality is substantially parallel to every other ridge in said second plurality and is transverse to said first plurality of ridges, and further wherein each ridge in said first and second pluralities has a substantially U-shaped cross section with a base portion and a pair of substantially parallel and opposite legs extending from the base portion to a respective edge to define a channel therebetween, wherein each ridge is oriented to position the base portion thereof at a distance "h" from the surface of said base layer;

a plurality of flaps, created from the base layer, wherein each flap extends from an edge of a respective ridge and into the channel thereof, and further wherein each flap is bonded to a leg of the respective ridge; and a plurality of overlap layers wherein each overlap layer covers a foot of each of the respective legs and extends therefrom for contact with the surface of the base layer and with the legs of the respective ridge to bond therewith and secure the respective ridge to the base layer, and wherein each flap is bonded to each of the legs of the respective ridge opposite from the overlap layers.

6. A panel as recited in claim 5 wherein the ridges of the first and second pluralities are made of a composite material and are co-cured with the base layer.

7. A reinforced panel formed as a base layer of a composite material having a substantially flat surface, wherein the base layer is formed with a first plurality of mutually parallel ridges extending as continuations of the base layer through a distance "h" from the substantially flat surface and a second plurality of mutually parallel ridges extending as continuations of the base layer through the distance "h" from the substantially flat surface, wherein the first plurality of ridges is transverse to the second plurality of ridges, wherein each ridge in said first and second pluralities has a substantially U-shaped cross section with a base portion and a pair of substantially parallel and opposite legs extending from the base portion to a respective edge to define a channel therebetween, and wherein each respective edge is formed as a foot for each of the legs, and said panel further comprises a plurality of overlap layers, each overlap layer covering said foot of each of the legs and extending therefrom for contact with the surface of the base layer and with the legs of each ridge to bond therewith, wherein the base layer forms a plurality of flaps, wherein each flap extends from one of the edges of each ridge and into the channel of each ridge and is bonded to the legs of the ridges opposite from the overlap layers.

8. A panel as recited in claim 7 wherein the first and second plurality of ridges create an iso-grid.

* * * * *